United States Patent [19]

Müller

[11] 4,050,573

[45] Sept. 27, 1977

[54] DISTRIBUTING STATION FOR PRINTED MATTER

[75] Inventor: Hans Müller, Zofingen, Switzerland

[73] Assignee: Grapha-Holding AG, Hergiswil, Switzerland

[21] Appl. No.: 607,837

[22] Filed: Aug. 25, 1975

[30] Foreign Application Priority Data

Aug. 27, 1974 Switzerland ..... 11642/74

[51] Int. Cl.[2] ..... B65G 47/00

[52] U.S. Cl. ..... 198/366; 198/586

[58] Field of Search ..... 198/20 R, 75, 83, 100, 198/105, 31 R, 95, 185, 92, 586, 369, 471, 601, 366

[56] References Cited

U.S. PATENT DOCUMENTS 982,920 1/1911 Aab ..... 198/185

1,928,371 9/1933 Drake ..... 198/20R 2,899,086 8/1959 de Saint-André ..... 198/92 X

*Primary Examiner*—Evon C. Blunk

*Assistant Examiner*—Douglas D. Watts

*Attorney, Agent, or Firm*—Michael J. Striker

[57] ABSTRACT

Two receiving conveyors of the station extend at opposite sides of the longitudinal axis of an intake conveyor and have their own longitudinal axes inclined to that of the intake conveyor so as to intersect the same at a point longitudinally spaced from all of these conveyors. A curved intermediate conveyor extends from the discharge end of the intake conveyor to the receiving end of the receiving conveyor and is pivotable about a vertical pivot axis passing through this point. A drive advances the intake and receiving conveyors and drives coupling members which are provided on the receiving conveyor and which can engage with cooperating coupling members on the intermediate conveyor.

10 Claims, 10 Drawing Figures

IV
IV
1
2
3
4
5
6
7,101
8
9,12
10
11
13
14
15
16
17
19
40
41
55
56
57
59
60
61
62
63
64
65
66
67
68
69
70
71
71'
74'
75
75'
77
77'
78
78'
85
86
88
89
90
91
92
93
94
95
96
97,105
98
99
100
102
103
104
106
107
108
109
109
113
118
127
128
130
131

DISTRIBUTING STATION FOR PRINTED MATTER

BACKGROUND OF THE INVENTION

This invention relates to a distributing station, particularly for printed matter.

More particularly, the invention relates to a distributing station for selectively channelling the stream of printed matter issuing from a folding machine which is fed by a printing machine, to at least two successive working stations.

Devices of the prior art are not properly suitable for the intended purpose.

SUMMARY OF THE INVENTION

It is therefore an object of the invention to provide a distributing station of the type and for the purpose in question.

In keeping with this object, and with others which will become apparent hereafter, one feature of the invention resides in a distributing station, particularly for printed matter, which comprises a. an intake conveyor having a first longitudinal axis and a discharge end;

b. two receiving conveyors arranged symmetrically at opposite sides of said longitudinal axis and having respective receiving ends, said receiving conveyors having second longitudinal axes which intersect said first axis at a point longitudinally spaced from all of said conveyors;

c. intermediate conveyor means extending from said discharge end to one of said receiving ends;

d. mounting means mounting said intermediate conveyor means so as to to be pivotable about a vertical pivot axis which passes through said point;

e. drive means for said intake and receiving conveyors;

f. first coupling members at said receiving ends of said receiving conveyors and driven by said drive means; and g. cooperating second coupling members on said intermediate conveyor means and engageable with said first coupling members.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
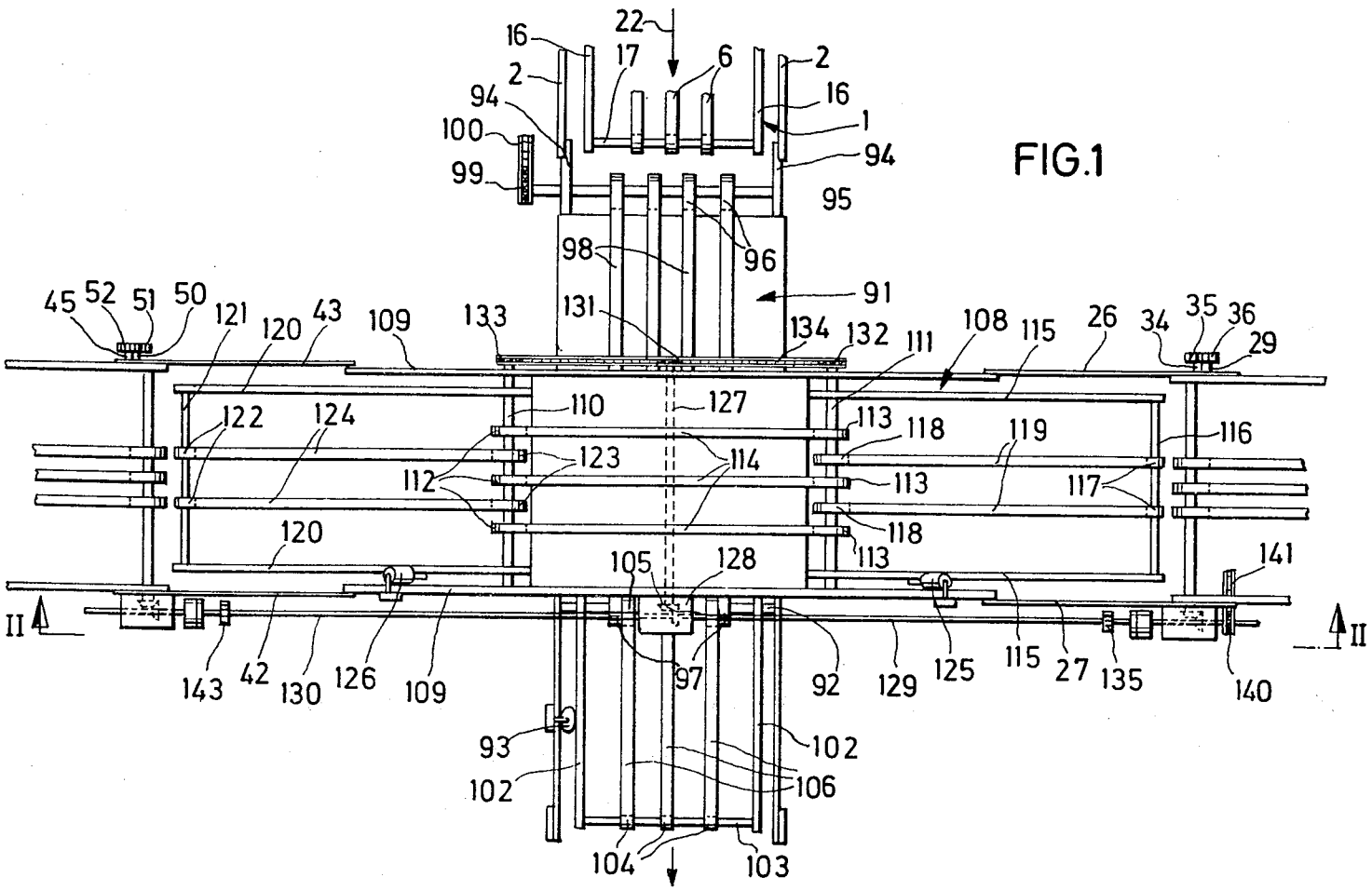
FIG. 1 is a top plan view of a station according to the invention.
Figure 2:
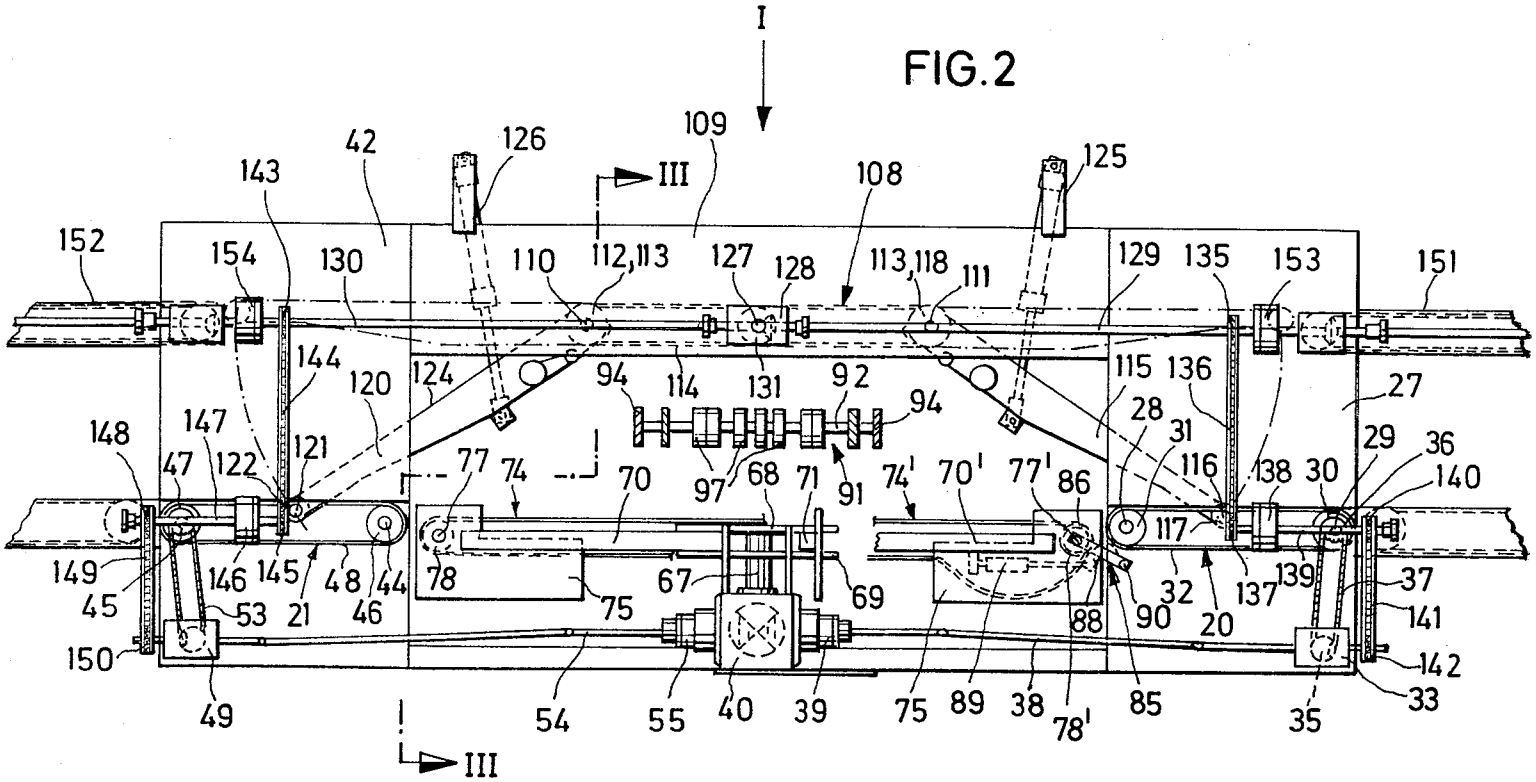
FIG. 2 is a section on line II—II of FIG. 1.
Figure 3:
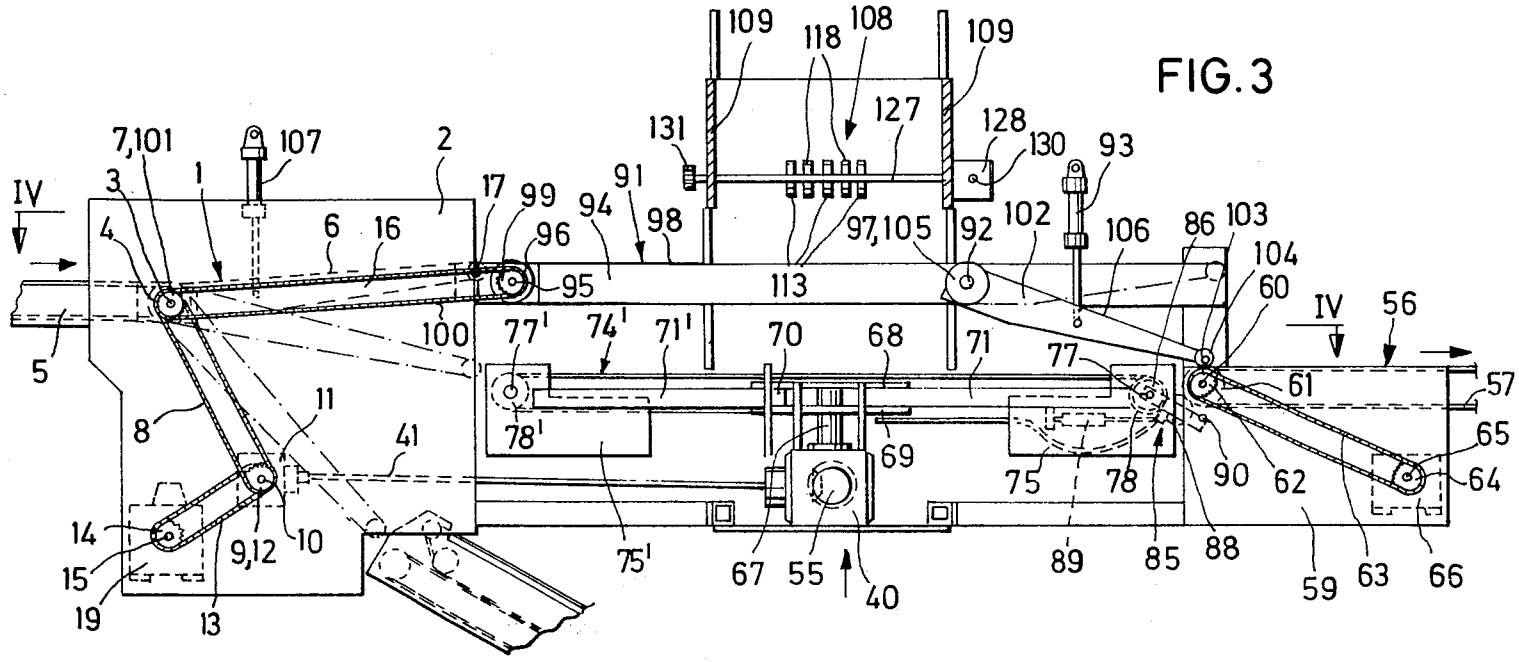
FIG. 3 is a section on line III—III of FIG. 2.
Figure 4:
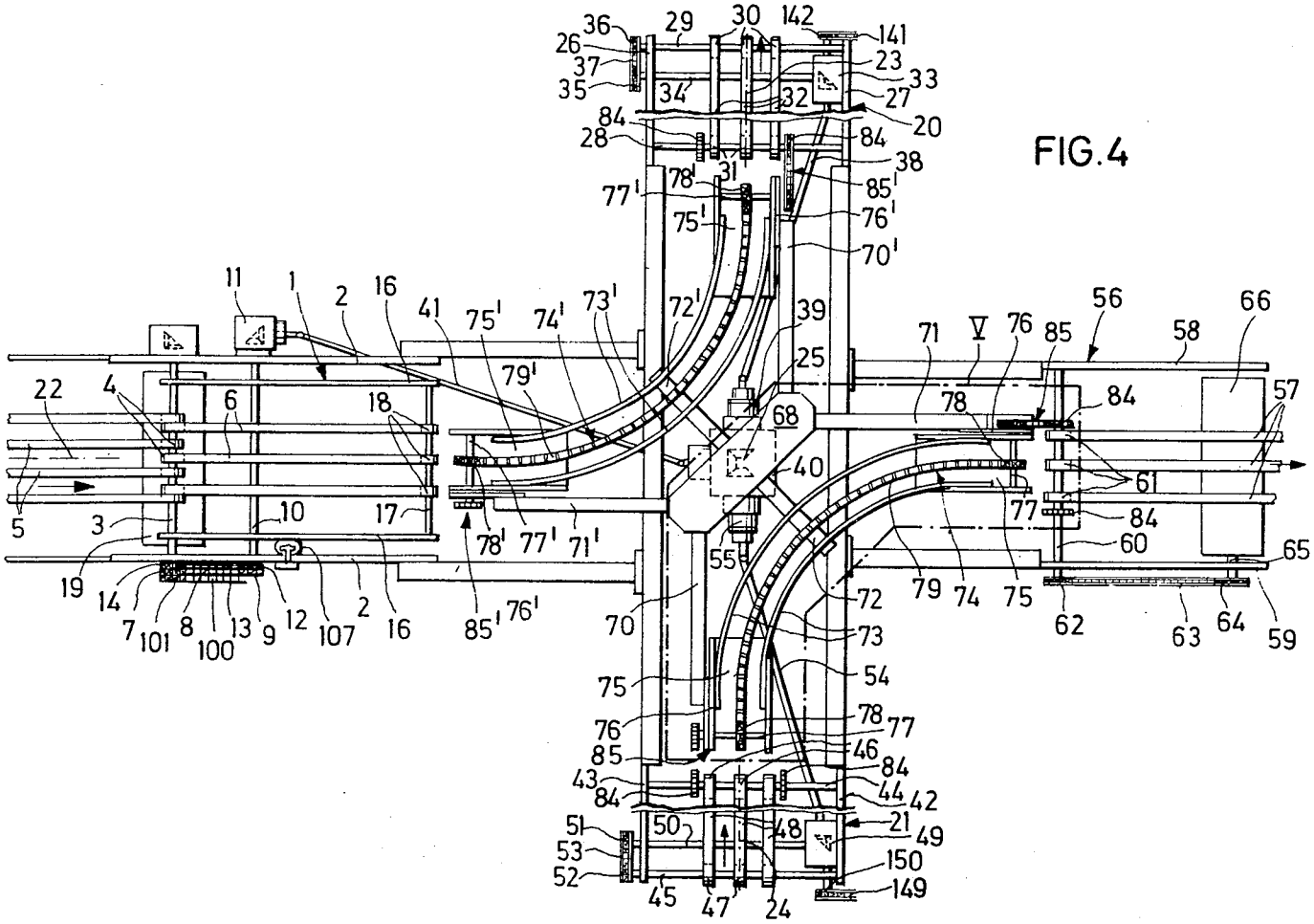
FIG. 4 is a section on line IV—IV of FIG. 3.

One embodiment of the invention is shown in FIGS. 1–6, wherein an intake conveyor is identified with reference numeral 1. It has two bearing members 2 in which a transverse shaft 3 is turnably journalled. Seven reversing rollers 4 are fixedly mounted on shaft 3 to rotate with, but not relative to, the shaft. Endless, preferably rubber-coated textile bands 5, 6 are trained about the rollers 4.

A chain sprocket 7 is fixedly mounted on shaft 3 and connected via a chain 8 with a further chain sprocket 9 which is mounted on a drive shaft 10 of an angle drive 11, which drive shaft 10 is turnably mounted in the bearing members 2. The shaft 10 is further connected with an output shaft 15 of a motor 19 via a sprocket 12, a chain 13 and a sprocket 14.

Two arms 16 are pivotably mounted on the shaft 3; their free ends are connected by a shaft 17 on which three reversing rollers 18 are turnably journalled. The bands 6 are trained about these rollers 18. The terminal part of the conveyor 1, formed by the arms 16, shaft 17 and bands 6, permits the end of conveyor 1 to be pivoted about shaft 3. Bands 5, 6 are driven by the motor 19 via chains 8 and 13.

Spaced from the end of the conveyor 1, extending at right angles to the same, there are arranged two receiving conveyors 20 and 21 which are symmetrical relative to the longitudinal axis 22 of the conveyor 1. The position is such that the longitudinal center axes center axes 23 and 24 of the conveyors 20, 21 and the longitudinal center axis 22 of the conveyor 1, intersect one another in a point 25 outside (i.e spaced from) the conveyors 1, 20 and 21.

The conveyor 20 has two bearing elements 26 and 27 and two shafts 28 and 29 which are freely turnably journalled in the bearing elements 26 and 27. Each of the shafts 28 and 29 is provided with three reversing rollers 30 and 31, respectively, about which endless, preferably rubber-coated, textile bands 32 are trained. An angle drive 33 is mounted at the base of the bearing element 27 and has an output shaft 34 which is freely turnably journalled in the bearing element 26 and which carries on its free end a chain sprocket 35. In addition to the rollers 30, the shaft 29 carries a fixedly mounted (i.e. for rotation with but not relative to the shaft) chain sprocket 36 which cooperates with the sprocket 35 via a chain 37. The angle drive 33 is connected with the output shaft of a coupling 39 via an articulated shaft 38; the coupling 39 forms a connection to one output shaft of a double-sided angle drive 40. The latter is driven by the angle drive 11 via an articulated shaft 41. Thus, the motor 19 will be seen to drive the bands 32 via sprocket 14, chain 13, sprocket 9, shaft 38, angle drive 33, shaft 34, sprocket 35, chain 37, sprocket 36 and shaft 29.

Conveyor 21 is constructed and driven in the same manner as described above with reference to conveyor 20. It has two lateral bearing elements 42 and 43 in which shafts 44 and 45 are freely turnably journalled. The shafts 44, 45 each carry three fixedly mounted rollers 46, 47, respectively, about which endless rubber-coated textile bands 48 are trained. An angle drive 49 is mounted on bearing element 42 and has an output shaft 50 which is freely turnably journalled in bearing element 43. The free end of the shaft 50 carries a chain sprocket 51 which cooperates with a further chain sprocket 52 via a chain 53. Chain sprocket 52 is fixedly mounted on the shaft 45. The angle drive 49 is driven via an articulated shaft 54 by a coupling 55 which connects the second output shaft of the angle drive 40 with the shaft 54. It will thus be seen that motor 19 also drives the bands 48, namely via angle drive 40, the coupling 55, the shaft 54, the angle drive 49, the shaft 50, the sprocket 51, the chain 53, the sprocket 52 and the shaft 45. Therefore, either of the conveyors 20, 21 can be individually driven, or both can be simultaneously driven, by selective operation of the couplings 39 and 55.

Opposite the conveyor 1 and at right angles to the receiving conveyors 20 and 21 there is provided a further receiving conveyor 56 which is located between lateral bearing elements 58 and 59 and has three endless rubber-coated textile bands 57. Shafts 60 (only one visible) are freely turnably journalled in bearing elements 58, 59 and each carry three reversing rollers about which the bands 57 are trained. A chain sprocket 62 is fixedly mounted on the shaft 60 for rotation therewith and cooperates via a chain 63 with another sprocket 64 that is fixedly mounted on the output shaft 65 of a motor 66. Thus, motor 66 drives the bands 57 via sprocket 64, chain 63, sprocket 62 and shaft 60.

The angle drive 40 includes a shaft 67 which is freely turnably journalled in the housing of the drive. Two parallel carrier plates 68 and 69 are secured to the shaft 67, and four members 70, 71, 70', 71' of preferably quadratic cross-section are mounted between the plates 68, 69. Also mounted on these plates are two supports 72, 72' which carry guide rails 73, 73' of intermediate conveyors 74, 74'. Protective covers 75, 75' for the chains are mounted on the ends of the guide rails 73, 73'.

Mounting plates 76, 76' are secured to the ends of the members 70, 71, 70', 71'. The plates 76, 76' and the respectively associated protective covers 75, 75' carry freely turnably journalled shafts 77, 77' which in turn have fixedly mounted thereon the respective illustrated chain sprockets 78, 78'. Endless flexible chains 79, 79' are trained about the respective sprockets 78, 78'.

Figures 5, 6:
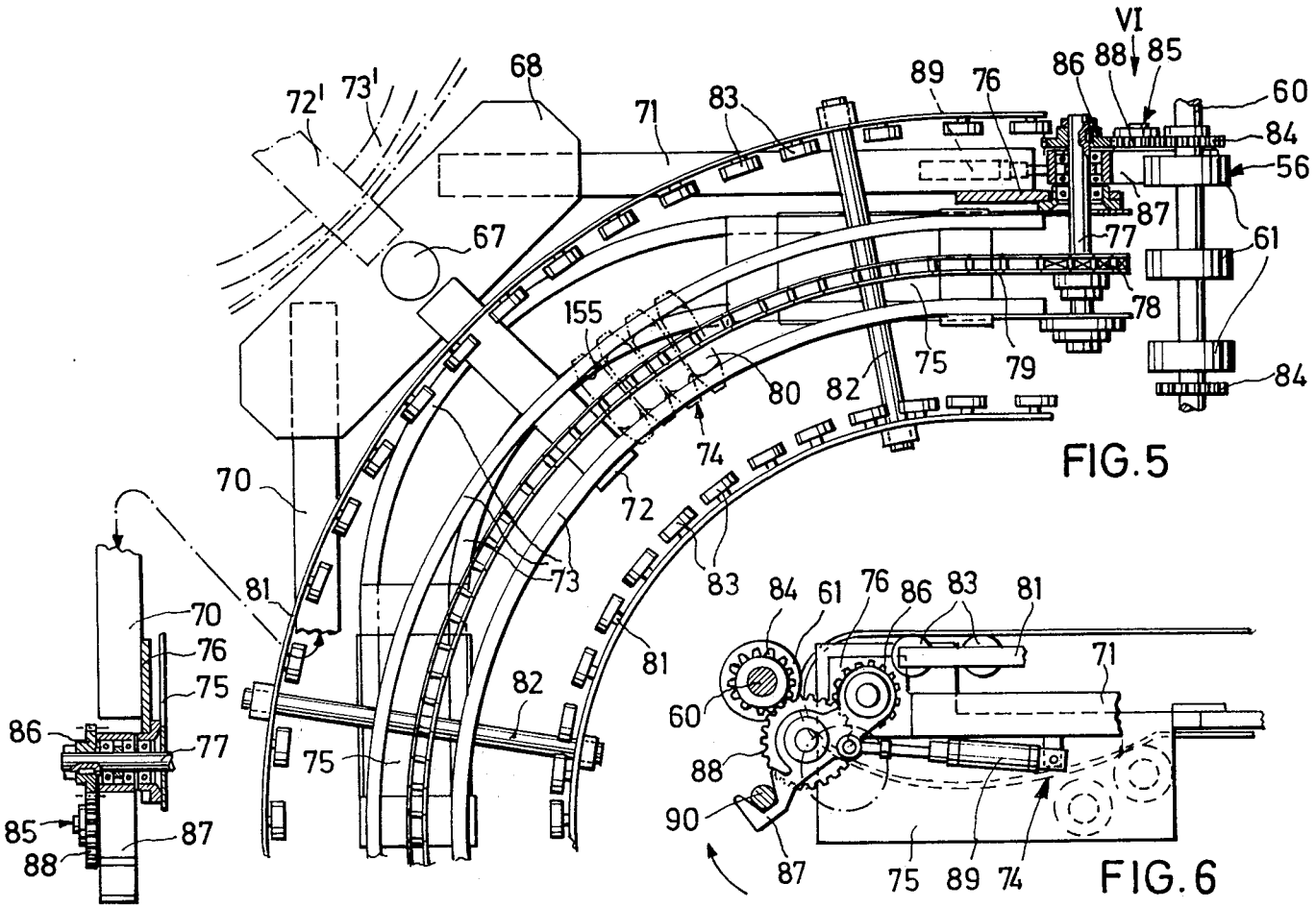
FIG. 5 shows the detail V of FIG. 4 on an enlarged scale.
FIG. 6 is a view in the direction of the arrow VI of FIG. 5.

FIG. 5 shows that plates 80 are mounted on the chain 79 with slight spacing from one another; these plates are also present on chain 79' although not shown in the drawing. The undersides of plates 80 are provided with guides 81 by means of which the plates are guided between the rails 73, 73'. Laterally of the upper guide rails 73 there are provided support or carrier rails 81 (see FIG. 5) which are rigidly connected with the guide rails 73 by means of braces 82. Support rollers 83 are freely turnably journalled on the support rails 81 and their upper peripheral portions extend tangentially of the plane formed by the supporting surfaces of the plates 80. Thus, a stream of overlapped printed matter, e.g. folded newspapers, on the plates 80 is supported along the edges of the stream by the rollers 83.

The shafts 29, 44 and 60 of the conveyors 20, 21 and 41 each carry two pinions 84 which rotate with them. Each of these pinions constitutes a first coupling member which can cooperate with a second coupling member 85 or 85' mounted at the ends of the conveyors 74, 74' so as to transmit motion to the latter. FIGS. 5 and 6 show the construction of the second coupling members 85, 85'. It will be seen that a pinion 86 is mounted on shaft 77 for rotation therewith. An arm 87 is also mounted on the shaft 77, for pivotal movement, and carries a freely turnable pinion 88 which meshes with pinion 86. A cylinder and piston unit 89 has its one end articulately connected to the member 71 and its other end is similarly connected to the arm 87. When a pressure medium is applied to the unit 89, the piston rod thereof can be extended and retracted so as to pivot the arm 87 in one or in an opposite direction.

When the arm 87 is in position in which it engages an abutment member 90, the pinion 88 meshes with the pinion 84 and the conveyors 74, 74' are driven synchronously with the conveyors 20, 21 and 56 via the coupling members 84, 85. If, for example, a stream of overlapped printed sheets or the like is coming in via conveyor 1 and is to be distributed or diverted to the conveyor 20, then the conveyor 74' is moved to the position shown in FIG. 4 and the coupling members 85' brought into mesh with the pinion 84 on shaft 29. This results in the conveyor 20, the conveyor 74' and the conveyor 1 all being driven in synchronism by the motor 19. If at the same time the coupling members 84 of the conveyor 74 are brought into mesh with the pinion 84 on shaft 60 of conveyor 56 and the motor 66 is energized, a stream of printed sheets or the like can simultaneously be directed from the conveyor 21 onto the conveyor 56 via the conveyor 74. In this case, the coupling 55 must be disengaged and the coupling elements 85 brought into engagement with the pinion 84 on shaft 44, so that conveyor 56, conveyor 74 and conveyor 21 move in synchronism upon energization of the motor 66.

In the event the stream of sheets or the like is to be deflected from conveyor 1 onto conveyor 21, then the coupling members 84', 84 and 85, 84 are disengaged and the conveyor 74' is turned with the shaft 67 through 90° to cause it to bridge the space between the conveyors 1 and 21. The coupling members 85' which in FIG. 4 face the conveyor 1, now face the conveyor 21 after the 90° turn is completed and are engaged with the pinion 84 on shaft 44. Now, the coupling 55 is engaged and the coupling 39 disengaged, and the conveyor now advances synchronously with the conveyors 74' and 1. At the same time, a stream of sheets or the like can be diverted from conveyor 20 onto conveyor 56, by moving the appropriate coupling elements 85 of the conveyor into engagement with the corresponding pinion 84 on shaft 28.

Figure 7:
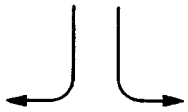
FIG. 7 is a diagram showing the distributing scheme that is possible with the embodiment of FIGS. 1–6.
Figure 8:
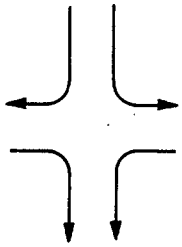
FIG. 8 is a view similar to FIG. 7 but showing the distributing scheme possible with a further embodiment.

If the stream is to be diverted from the conveyor 1 only to the respective conveyors 20 and 21, i.e. in the manner shown graphically in FIG. 7, then only one of the conveyors 74 and 74' is required. The other one can be omitted, together with the conveyor 56. If the latter is present and a distribution according to FIG. 8 is desired, then both conveyors 74 and 74' are required.

Following the end portion of conveyor 1 there is provided a first bridged conveyor 91 which is located above the conveyors 74, 74'. The end of the conveyor 91 which is farthest from the conveyor 1 is pivotable about a transverse shaft 92 by means of a cylinder-and-piston unit. When this end is pivoted into the lower end position, it extends into the feed path of the conveyor 56.

The conveyor 91 has two lateral stationary supports 94 in which the shaft 92 and a further shaft 95 are freely turnably journalled. Each of the shafts 92, 95 carries four rollers 96, 97, respectively, about which rubber-coated endless textile bands 98 are trained. In addition, the shaft 95 carries a chain sprocket 99 that turns with the shaft 95 and is connected with a further sprocket 101 via a chain 100. This arrangement obtains synchronous advancement of the bands 98 with the conveyor 1. Two carriers 102 are pivotably mounted on the shaft 92 and have free ends which are rigidly connected with one another by a shaft 103. Three rollers 104 are freely turnably mounted on the shaft 103. Corresponding rollers 105 are mounted on the shaft 92 to rotate therewith and endless rubber-coated textile bands 106 are trained about the rollers 104, 105 and are thus driven synchronously with the bands 98.

Figure 9:
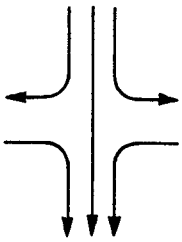
FIG. 9 is a diagrammatic view showing the distributing scheme according to an additional embodiment.

If a stream of sheets or the like travelling on conveyor 1 is to be diverted onto the conveyor 56, then a cylinder-and-piston unit 107 is operated which displaces the end of conveyor 1 to a position in which the stream travels onto the conveyor 91. The opposite end of the conveyor 91 is pivoted downwardly (FIG. 3) by operation of the earlier mentioned unit 93, and the conveyor 91 thus discharges the stream onto the conveyor 56. This arrangement thus makes it possible to obtain the distribution scheme (i.e. the various different diversion possibilities) shown in FIG. 9.

Figure 10:
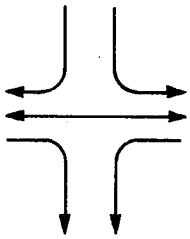
FIG. 10 is a diagrammatic illustration of the distributing scheme according to yet another embodiment.

If it is desired to obtain the distribution scheme shown in FIG. 10, then a second bridging conveyor 108 is arranged above the first bridging conveyor 91, extending transverse to the same. The conveyor 108 has two stationary bearing members 109 in which two shafts 110 and 111 are freely turnably journalled. Three rollers 112 are mounted on the shaft 110 for rotation therewith, and three rollers 113 are similarly mounted on the shaft 111. Endless, rubber-coated textile bands 114 are trained about these rollers 112, 113. Two carriers 115 are pivotally mounted on shaft 111 and have free ends that are rigidly connected by a shaft 116. Two freely turnable rollers 117 are mounted on the shaft 116 and corresponding rollers 118 are mounted on the shaft 111. Respective endless rubber-coated textile bands 119 are trained about the rollers 117, 118. In an analogous manner, two carriers 120 are pivotally mounted on the shaft 110 and have their free ends rigidly connected by a shaft 121. Two rollers 122 are freely turnably mounted on the shaft 121, and two corresponding rollers 123 are mounted on the shaft 110. Two endless rubber-coated textile bands 124 are trained about the rollers 122, 123.

A cylinder-and-piston unit 125 has a free end pivoted to one of the carriers 115; a similar unit 12 has a free end pivoted to one of the carriers 120. The other ends of the units 125, 126 are pivoted to the bearing member 109. By operation of the respective units 125, 126, the ends of conveyor 108 can be raised or lowered at will. When these ends are lowered to their lower end position they extend into the free paths of the conveyors 20, 21.

A shaft 127 is freely turnably journalled in bearing members 109. One of its end portions extends into an angle drive 128 which can be driven by a shaft 129 and also by a shaft 130. The free end of the shaft 127 carries a chain sprocket 131, and corresponding chain sprockets 132 and 133 are mounted on the shafts 111, 110 for rotation therewith. A chain engages with the sprockets 131, 132 and 133. Shaft 129 is driven in rotation by a chain sprocket 135, a chain 136, a chain sprocket 137, a coupling 138, a shaft 139, a chain sprocket 140 and a chain 141, from a chain sprocket 142 which is mounted on an output shaft of the angle drive 33. This motion transmitting arrangement can be interrupted at will by disengaging the coupling 138. Angle drive 128 can also be driven from a chain sprocket 150 on the output shaft of the angle drive 49, via a shaft 130, a sprocket 143, a chain 144, a sprocket 145, a coupling 146, a shaft 147, a sprocket 148, and a chain 149 which engages the sprocket 150. This motion-transmission can be interrupted at will by disengaging the coupling 146.

If it is desired to divert a stream of sheets or the like from the conveyor 21 to the conveyor 20, the ends of the conveyor 108 are lowered, the coupling 146 is disengaged and the coupling 138 is engaged, so that the conveyor 108 is driven synchronously with the conveyor 20 by the angle drive 33. The conveyor 20 at this time is being driven in synchronism with the conveyor 21 by the angle drive 40. Thus, a stream of sheets or the like is transferred from the conveyor 21 onto the conveyor 108 and from there to the conveyor 20 for further transportation by the same. Conversely, if the stream is to be directed from the conveyor 20 onto the conveyor 21, the ends of the conveyor 108 are lowered, coupling 138 is disengaged, coupling 146 is engaged, and the direction of advancement of conveyors 20 and 21 is reversed from the previous example.

Additional conveyors 151 and 152 are arranged at the level of the conveyor 108, parallel to and above the conveyors 20, 21. When the ends of conveyor 108 are raised, the conveyors 151. 152 form with these ends (and hence with conveyor 108) a continuous feed path.

Conveyor 151 is coupled with and driven by the shaft 129 via a coupling 153; conveyor 152 is similarly coupled with the shaft 130 via a coupling 154. The presence of the conveyors 151, 152 makes it possible, at the will of an operator to direct a stream of sheets or the like from the conveyor 151 via the conveyor 108 onto the conveyor 21 or the conveyor 152, or to direct the stream from the conveyor 152 onto the conveyors 20 or 151.

Depending upon which of the distribution schemes shown in FIGS. 7–10 is selected, the conveyor 108 and/or the conveyor 91 and/or one of the conveyors 74, 74' can be omitted.

The reference to rubber-coated textile bands throughout this specification is not limited to an actual coating, but refers also to impregnation or general rubberizing of the bands.

The flow directions indicated in FIGS. 7–10 by the respective arrows for the stream of sheets or other articles, should always be understood to originate at the conveyor 1; i.e. the stream is supplied by the conveyor 1 and is then distributed or diverted as indicated by the respective arrows.

It will be understood that each of the elements described above, or two or more together, may also find a useful application in other types of applications differing from the types described above.

While the invention has been illustrated and described as embodied in a distributing station for sheet materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patents is set forth in the appended claims.

1. A station for distributing articles, particularly printed matter, comprising an intake conveyor having a first longitudinal axis and a discharge end; two receiving conveyors arranged symmetrically at opposite sides of said longitudinal axis and having respective receiving ends, said receiving conveyors having second longitudinal axes which intersect said first axis at a point longitudinally spaced from all of said conveyors; intermediate conveyor means; mounting means mounting said intermediate conveyor means for pivoting about a vertical pivot axis which passes through said point between a first position in which said intermediate conveyor means extends from said discharge end to one of said receiving ends and a second position in which said intermediate conveyor means extends from said discharge end to the other receiving end; drive means for said intake and receiving conveyors; first coupling members at said receiving ends of said receiving conveyors and driven by said drive means; cooperating second coupling members on said intermediate conveyor means and operative for driving the latter; and means for engaging said second coupling members with said first coupling members of the respective receiving end of the respective receiving conveyor to which said intermediate conveyor means extends for driving the latter proportionately to said respective receiving conveyor to obtain a continuous advancement of the articles from said intake conveyor to said respective receiving conveyor in each of said first and second positions of said intermediate conveyor means, and for disengaging said first and second coupling members from one another to free said intermediate conveyor means for pivoting between said first and second positions.

2. A distributing station as defined in claim 1, wherein said intermediate conveyor means is curved.

3. A distributing station, particularly for printed matter, comprising an intake conveyor having a first longitudinal axis and a discharge end; two receiving conveyors arranged symmetrically at opposite sides of said longitudinal axis and having respective receiving ends, said receiving conveyors having second longitudinal axes which intersect said first axis at a point longitudinally spaced from all of said conveyors; an additional receiving conveyor angularly spaced from each of said receiving conveyors by 90°; intermediate conveyor means including two intermediate conveyors one of which extends from said discharge end to one of said receiving ends; mounting means mounting said intermediate conveyor means so as to be pivotable about a vertical pivot axis which passes through said point; drive means for said intake and all of said conveyors; first coupling members at said receiving ends of said receiving conveyors and driven on said intermediate conveyor means and engageable with said first coupling members.

4. A distributing station as defined in claim 3, said discharge end of said intake conveyor being pivotable about a transverse axis into and out of an upper position in which it is located upwardly of said intermediate conveyors; further comprising a bridging conveyor above said intermediate conveyors adjacent to said upper position and having an end portion that is pivotable about a transverse axis so as to become located on said additional receiving conveyor; and transmission means connecting said drive means with said bridging conveyor.

5. A distributing station as defined in claim 4; further comprising an additional bridging conveyor located vertically above the first-mentioned bridging conveyor and offset through 90° relative thereto, said additional bridging conveyor having two spaced end portions each pivotable about a respective transverse axis into an upper and a lower end position, said spaced end portions being located in the transporting path of one of said two receiving conveyors when located in the respective lower end position; and wherein said transmission means connects said drive means also with said additional bridging conveyor.

6. A distributing station, particularly for printed matter, comprising an intake conveyor having a first longitudinal axis and a discharge end; two receiving conveyors arranged symmetrically at opposite sides of said longitudinal axis and having respective receiving ends, said receiving conveyors having second longitudinal axes which intersect said first axis at a point longitudinally spaced from all of said conveyors; intermediate conveyor means extending from said discharge end to one of said receiving ends and having an end portion and a shaft at said end portion; mounting means mounting said intermediate conveyor means so as to be pivotable about a vertical pivot axis which passes through said point; drive means for said intake and receiving conveyors; first coupling members at said receiving ends of said receiving conveyors and driven by said drive means and cooperating second coupling members on said intermediate conveyor means, said second coupling members including a first pinion on said shaft and a pivotable arm on said shaft and carrying a freely turnable second pinion meshing with said first pinion, said first coupling members including a third pinion mounted on a shaft of one of said receiving conveyors and located in the path of pivotal movement of said second pinion for engagement by the same; and means for engaging said second coupling members with and disengaging the same from said first coupling members.

7. A distributing station, particulating for printed matter, comprising an intake conveyor having a first longitudinal axis and a discharge end; two receiving conveyors arranged symmetrically at opposite sides of said longitudinal axis and having respective receiving ends, said receiving conveyors having second longitudinal axes which intersect said first axis at a point longitudinally spaced from all of said conveyor; intermediate conveyor means extending from said discharge end to one of said receiving end and including an intermediate conveyor having two reversing shafts, an endless flexible chain trained about said shafts, guide rails at opposite sides of said chain, and workpiecesupporting plates connected to said chain for movement therewith and being guided by said guide rails; mounting means mounting said intermediate conveyor means so as to be pivotable about a vertical pivot axis which passes through said point; drive means for said intake and receiving conveyors; first coupling members at said receiving ends of said receiving conveyors and driven by said drive means, and cooperating second coupling members on said intermediate conveyor means and engageable with said first coupling members.

8. A distributing station as defined claim 7; further comprising support rails laterally of said plates at opposite sides of said chain and provided with turnable supporting rollers having upper circumferential portions which extend tangentially to the common plane of said supporting plates.

9. A distributing station as defined in claim 7; said intermediate conveyor having an upper and a lower run, and said guide rails including guide rails for said lower run which extend in the region of said reversing shafts at right angles to the latter.

10. A distributing station, particularly for printed matter, comprising an intake conveyor having a first longitudinal axis and a discharge end; two receiving conveyors arranged symmetrically at opposite sides of said longitudinal axis and having respective receiving ends, said receiving conveyors having second longitudinal axes which intersect said first axis at a point longitudinally spaced from all of said conveyors; intermediate conveyor means extending from said discharge end to one of said receiving ends, including an intermediate conveyor, having two reversing shafts, an endless flexible chain trained about said shafts, guide rails at opposite sides of said chain, and workpiece-supporting plates connected to said chain for movement therewith and being guided by said guide rails; mounting means mounting said intermediate conveyor means so as to be pivotable about a vertical pivot axis which passes through said point; drive means for said intake and receiving conveyors; first coupling members at said receiving ends of said receiving conveyors and driven by said drive means; cooperating second coupling members on said intermediate conveyor means; and means for engaging said second coupling members with and disengaging the same from said first coupling members.

* * * * *